US007141282B2

(12) United States Patent
Demars et al.

(10) Patent No.: US 7,141,282 B2
(45) **Date of Patent: *Nov. 28, 2006**

(54) INSULATING GLAZING AND METHOD FOR MAKING SAME

(75) Inventors: Yves Demars, Clermont (FR); Jean-Cristophe Elluin, Choisy au Bac (FR); Boris Vidal, Thourotte (FR)

(73) Assignee: Saint-Gobain Glass France, Courbevoie (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/239,859

(22) PCT Filed: Apr. 11, 2001

(86) PCT No.: PCT/FR01/01106

§ 371 (c)(1),
(2), (4) Date: Oct. 2, 2002

(87) PCT Pub. No.: WO01/79644

PCT Pub. Date: Oct. 25, 2001

(65) Prior Publication Data

US 2004/0209019 A1 Oct. 21, 2004

(30) Foreign Application Priority Data

Apr. 13, 2000 (FR) ..... 00 05012

(51) Int. Cl.
*E06B 3/24* (2006.01)
*E04C 2/54* (2006.01)

(52) U.S. Cl. ..... 428/34; 52/786.13

(58) Field of Classification Search ..... 428/34, 428/192; 52/786.1, 786.13; 156/109
See application file for complete search history.

(56) References Cited

U.S. PATENT DOCUMENTS

| | | | | | |
|---|---|---|---|---|---|
| 2,213,468 | A | * | 9/1940 | Haven | 428/34 |
| 2,235,680 | A | * | 3/1941 | Haven et al. | 428/34 |
| 2,618,819 | A | * | 11/1952 | Goodwillie | 428/34 |
| 3,669,785 | A | * | 6/1972 | Bowser et al. | 156/109 |
| 3,758,996 | A | * | 9/1973 | Bowser | 55/385.1 |
| 3,919,023 | A | | 11/1975 | Bowser | |
| 3,921,359 | A | * | 11/1975 | Brichard et al. | 52/786.13 |
| 4,109,431 | A | * | 8/1978 | Mazzoni et al. | 52/172 |
| 5,079,054 | A | * | 1/1992 | Davies | 428/35.8 |
| 5,270,084 | A | * | 12/1993 | Parker | 428/34 |

FOREIGN PATENT DOCUMENTS

| | | |
|---|---|---|
| CA | 1 290 624 | 10/1991 |
| EP | 0 671 534 | 9/1995 |
| FR | 2 115 932 | 7/1972 |
| FR | 2 428 728 | 1/1980 |
| FR | 2 774 625 | 8/1999 |
| GB | 1 102 983 | 2/1968 |

* cited by examiner

*Primary Examiner*—Donald J. Loney
(74) *Attorney, Agent, or Firm*—Oblon, Spivak, McClelland, Maier & Neustadt, P.C.

(57) ABSTRACT

An insulating glazing unit including at least two glass sheets separated by, e.g., a gas-filled cavity. An insert serves for spacing the at least two glass sheets apart and has an internal face facing the gas-filled cavity and an opposed external face, together with a mechanism for sealing the inside of the glazing unit. The insert is in the form of a substantially flat profiled strip that girds the perimeter of the glazing unit by its internal face being pressed against the edges of the at least two glass sheets and held fast by a fastening device.

23 Claims, 2 Drawing Sheets

INSULATING GLAZING AND METHOD FOR MAKING SAME

The subject of the invention is an insulating glazing unit and its manufacturing process.

One well-known type of insulating glazing unit comprises two glass sheets which are spaced apart, by a cavity filled with gas such as air, and are separated and joined together by means of a spacer frame consisting of hollow metal profiled strips which are bent or assembled by corner pieces. The profiled strips are lined with a molecular sieve whose purpose is especially to absorb the water molecules which are trapped in the air cavity at the time of manufacture of the glazing unit and which would be liable to condense in cold weather, resulting in the appearance of misting.

To seal the glazing unit, the spacer frame is adhesively bonded to the glass sheets by a bead of elastomer of the butyl rubber type, applied directly to the profiled strips by extruding it through a nozzle. Each corner of the spacer frame is also provided at the corner piece with butyl rubber. Once the glazing unit has been assembled, the bead of sealing elastomer temporarily acts to mechanically hold the glass sheets in place. Finally, a crosslinkable sealing mastic, of the polysulphide or polyurethane type, is injected into the peripheral groove bounded by the two glass sheets and the spacer frame, which operation completes the mechanical assembly of the glass sheets. The main purpose of the butyl rubber is to seal the inside of the glazing unit from water vapor, whereas the mastic seals against solvents or liquid water.

The manufacture of this glazing unit requires several separate materials, including profiled strips, corner pieces, molecular sieve and organic seals, these materials not being assembled in one and the same operation.

One drawback resulting from such manufacture is the storage of the materials. To be operational for any new order for insulating glazing units, many batches of each material must be available. This does not help to achieve simple and quick stock control as regards to both the procurement and the storage of these materials.

Furthermore, the current number of materials to be assembled results in several assembly operations which, although automated, are carried out one after another, thereby significantly extending the manufacturing time. Some of these operations also mean that there must be interruptions in the manufacturing line, which may, because of these short dead times, further reduce the production rate.

It is therefore an object of the invention to obviate these drawbacks by providing an insulating glazing unit whose materials are chosen so as to facilitate the management of their manufacturing flow and to simplify the assembly operations.

According to the invention, the insulating glazing unit, which comprises at least two glass sheets separated by a gas-filled cavity, an insert serving for spacing the two glass sheets apart and having an internal face facing the gas-filled cavity and an opposed external face, together with means for sealing the inside of the glazing unit, is characterized in that the insert is in the form of a substantially flat profiled strip which girds the perimeter of the glazing unit by its internal face being pressed against the edges of the glass sheets and held fast by fastening means.

This type of profiled strip and its positioning on the edges of the glazing unit have in particular the advantage of increasing the visibility through the glazing unit since the insert is no longer visible around the periphery.

According to one feature, the means for sealing the glazing unit against gases, dust and liquid water are placed at least on the external face of the insert. These sealing means consist of a metal coating, preferably made of stainless steel or aluminium, which has a thickness of between 2 and 50 μm.

According to a preferred embodiment of the insert, the latter is based on a thermoplastic which may or may not be reinforced with reinforcing fibres, such as chopped or continuous glass fibres.

According to one feature, the insert has a linear buckling strength of at least 400 N/m. To ensure this strength, the insert must have a thickness of at least 0.1 mm when it is made entirely of stainless steel, at least 0.15 mm when it is made entirely of aluminium and at least 0.25 mm when it is made of a thermoplastic reinforced with reinforcing fibres.

Advantageously, the means for fastening the insert to the glazing unit are impermeable to water and consist of an adhesive which has a tear strength of at least 0.45 MPa.

According to another feature, the free ends of the insert are joined together in order to gird the entire glazing unit so that one of the ends overlaps the other, complementary sealing means being provided in order to seal off the lateral portions left open by the overlap.

As a variant, in order to gird the entire glazing unit, the free ends of the insert have complementary shapes designed to fit together in order for them to be joined in an abutment. An adhesive tape or adhesive impermeable to gases and to water vapour will preferably be applied to the abutment region.

The manufacturing process of the invention is characterized in that:

- the two glass sheets are held parallel and spaced apart;
- the internal face of the insert provided with the fastening means is placed against the edges of the glass sheets over the entire perimeter of the glazing unit;
- virtually at the same time as fitting the insert, pressing means are applied against the external face of the insert so as to ensure that the insert adheres to the edges of the glass sheets; and
- after the entire glazing unit has been girded, the two ends of the insert are firmly assembled.

According to one characteristic, the insert before it is fitted is in the form of a wound tape which is intended to be unwound, stretched and cut to the length corresponding approximately to the perimeter of the glazing unit, while the adhesive-type fastening means are deposited by injection means on the tape being stretched.

Advantageously, a desiccant is deposited on the tape being stretched during application of the fastening means.

According to another feature, the insert is fitted by applying it, by compression at a starting point, against the edges of a first side of the glazing unit, the girding operation being carried out from this starting point and the tape being fitted to the corners of the glazing unit by preheating the external face of the insert so as to help to bend it around the corners and to closely follow their contour.

Preferably, the starting point is located at the middle of one side of the glazing unit so as to apply and compress the insert simultaneously in two opposed directions in order to gird the perimeter of the glazing unit along two perimeter halves. This saves manufacturing time.

As a variant, the starting point may instead be located at a corner of the glazing unit.

In an alternative way of girding the glazing unit, the insert is fitted by applying two tapes, by compression, at two starting points using distribution and compression means, and the girding operation is carried out from these starting points by translational movements of the glazing unit and/or of the distribution means. This variant, combined with the profiled strip of the invention, very advantageously allows a glazing unit of complex shape, particularly with curved parts, to be provided.

In practice, all the operations of manufacturing the glazing unit can be carried out in a chamber filled with the gas that has to be contained in the glazing unit. However, as a variant, it is possible to envisage a gas supply device which is inserted between the two glass sheets, in order to deliver gas while the glazing unit is being girded, and which is withdrawn just before the end of the girding operation.

Further features and advantages of the invention will become apparent on reading the description which follows and from the appended drawings in which.

Figure 5A:
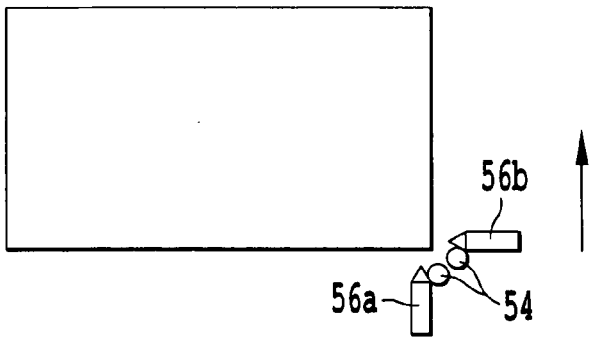
Figure 5B:
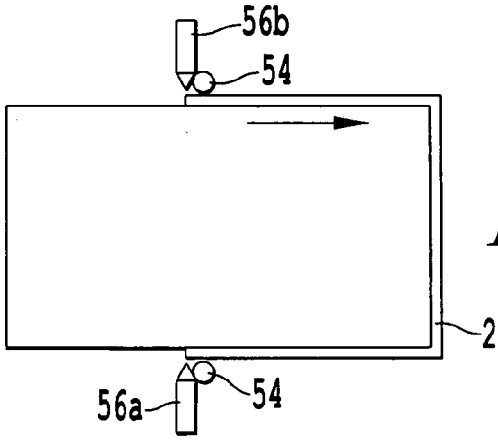
Figure 5C:
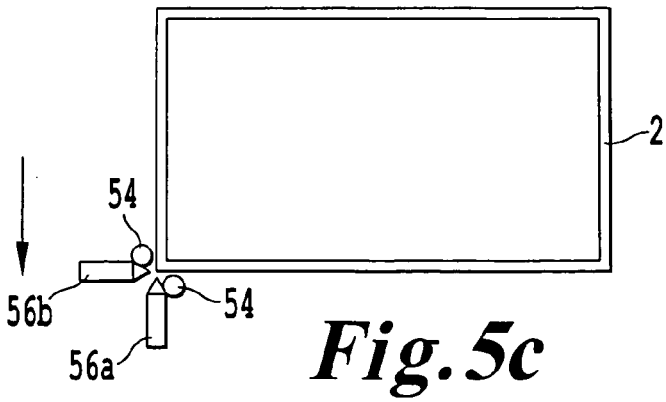

FIGS. 5*a* to 5*c* illustrate an alternative way of girding the glazing unit.

Figure 1:
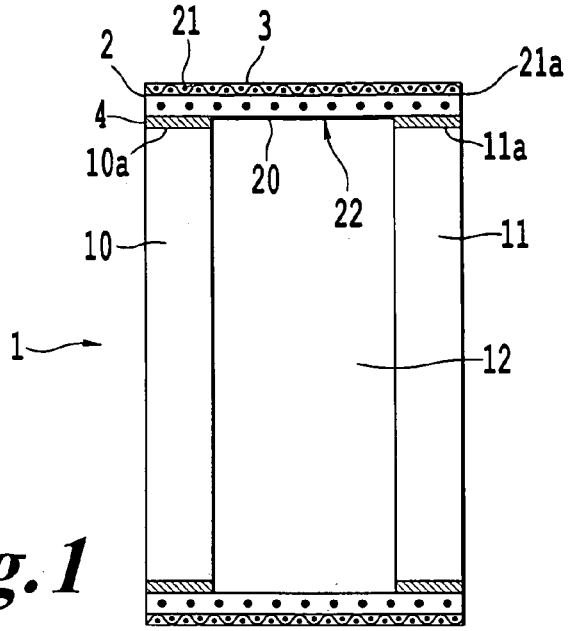
FIG. 1 is a cross-sectional view of an insulating glazing unit according to the invention.

FIG. 1 illustrates a simple insulating glazing unit 1 obtained by a manufacturing process which will be described later with regard to its apparatus seen in FIG. 2.

The glazing unit 1 comprises two glass sheets 10 and 11 separated by a gas-filled cavity 12, an insert 2 which serves to space the two glass sheets apart and has the function of ensuring mechanical retention of the entire glazing unit, and sealing means 3 intended to seal the glazing unit from liquid water, solvents and water vapour.

The insert 2 is in the form of a substantially flat profiled strip about 1 mm in thickness and approximately parallel-epipedal in cross section. This profiled strip advantageously has a low mechanical inertia, that is to say it can be easily wound up, having a small winding radius of 10 cm for example.

The profiled strip surrounds the perimeter of the glazing unit. It is placed in the manner of a tape along the edges 10*a* and 11*a* of the glass sheets and guarantee mechanical assembly of the glazing unit by virtue of fastening means 4 which ensure that it adheres strongly to the glass.

The profiled strip is rigid enough to fulfill the function of mechanically holding the two spaced-apart glass sheets in place. Its rigidity is defined by the very nature of its constituent material, the linear buckling strength of which must be at least 400 N/m.

Moreover, the nature of the material of the said profiled strip is also chosen so that, during the process of manufacturing the glazing unit, the profiled strip may be sufficiently flexible for the operation of girding the glass edges to be carried out, particularly when girding the corners.

In a first embodiment, the insert is made entirely of metal, the chosen material being preferably stainless steel or aluminium. During the process, the girding of the corners is carried out by bending the strip using machines well known to those skilled in the art of converting metallic materials.

In order to guarantee a minimum linear buckling strength of 400 N/m, the insert must have a thickness of at least 0.1 mm in the case of stainless steel and 0.15 mm in the case of aluminium.

In a second and preferred embodiment of the invention, the insert 2 is based on a plastic which may or may not be reinforced with chopped or continuous reinforcing fibres. Thus, one material may be styrene acrylonitrile (SAN) filled with chopped glass fibre, sold for example under the name LURAN® by BASF, or else polypropylene reinforced with continuous glass fibre, sold under the name TWINTEX® by Vetrotex.

We should point out that in the case of a plastic which is a thermoplastic, the action of girding the glazing unit corners by bending, after the material has been softened, is more easily carried out than with an entirely metallic material.

Moreover, when a plastic is used it may be highly advantageous to intrinsically incorporate, partially or completely, the desiccant in the profiled strip, something which is impossible with metal. The desiccant may be a molecular sieve, such as a powdered zeolite, the amount of which may be up to 20% by mass or about 10% by volume. The amount of desiccant depends on the lifetime that it may be wished to give the glazing unit.

Finally, since the plastic is much less thermally conducting than metal, the thermal insulation of the entire glazing unit can be much better thereby when the glazing unit is, for example, exposed to strong sunlight.

As regards the addition of glass fibre to the plastic, this results in a thermal expansion coefficient of the material which is much lower than that of a pure plastic and which becomes close to the coefficient of glass. This results, during a thermal variation in the gas-filled cavity, in a lower shear force on the fastening means 4.

To ensure a linear strength of 400 N/m, the insert 2 has a thickness of at least 0.25 mm when it is made of a thermoplastic and reinforcing fibres.

The width of the insert 2 is tailored to the total thickness of the glazing unit, which may be a multiple glazing unit comprising several glass sheets spaced apart by gas-filled cavities. Advantageously, the insert of the invention requires only the total width of the glazing unit to be known and not the distances separating the glass sheets. This is because the separating distances for a multiple glazing unit may vary. This necessarily means that, in the case of the use of inserts according to those of the prior art, there must be available, for manufacturing the glazing unit, several inserts for the different separations, and different insert widths according to the separation distances.

For any glazing unit, it is therefore necessary to have according to the invention simply one insert or profiled strip having a single width corresponding to the total width of the glazing unit, whatever the number of internal insulating separations in this glazing unit and the width of these separations.

According to the invention, the insert or profiled strip 2 comprises an internal face 20 and an opposed external face 21, the internal face 20 being intended to be pressed, and held, by its edges in the case of a single insulating glazing unit, against the edges 10*a* and 11*a* of the glass sheets using the fastening means 4.

The internal face 20 of the profiled strip has, in its central part 22 and facing the gas-filled cavity 12, the properties of those of a desiccant whose purpose is to absorb the water molecules which may be trapped in the gas-filled cavity. These desiccant properties may result from the nature of the material of the insert, the very composition of which incorporates a molecular sieve. As a variant, the desiccant will instead be obtained by depositing a molecular sieve on the central part 22 before the insert is fitted onto the edges of the glazing unit, as we will see in the rest of the description.

The edges of the internal face 20 are covered with an adhesive which constitutes the fastening means 4.

The adhesive is impermeable to gases and to water vapour. Tests carried out according to the American Standard ASTM 96-63T on adhesive specimens 1.5 mm in thickness have shown that an adhesive having a water-vapour permeability coefficient of 35 g/24 h.m$^2$, such as that of silicone, is suitable. Of course, an adhesive having a permeability coefficient of 4 g/24 h.m$^2$, such as polyurethane, or even lower, would be more suitable since even better sealing would be achieved and a lesser amount of desiccant would then have to be provided.

The adhesive must also resist delamination by liquid water, by ultraviolet radiation and by forces that may be exerted perpendicularly to the faces of the glazing unit and usually called shear stresses, and by forces exerted parallel to the force due to the weight of the glazing unit. A satisfactory adhesive must have a tear strength of at least 0.45 MPa.

Preferably, the adhesive must have rapid-bonding properties, bonding in a few seconds; it may be an adhesive which sets by a chemical reaction, whether or not activated by heat or by pressure, or by cooling if the adhesive consists of a hot-melt material, for example one based on a polyurethane that can crosslink by the moisture in the air.

The external face 21 of the reinforced plastic insert is covered with a metallic protective coating 21*a* of the aluminium or stainless-steel foil type, having a thickness of between 2 and 50 μm, this coating constituting the sealing means 3. Apart from its sealing function, the foil, particularly when it is made of stainless steel, gives the profiled strip effective abrasion resistance, for example when it is being handled or transported. Finally, it promotes heat exchange with the thermoplastic when the latter has to be softened during the manufacturing process.

As a variant, the metal coating 21*a* could be wide enough to cover the external face 21 and be turned down over the edges of the internal face 20.

The values given above about the thickness of the insert according to the nature of the material used are provided for a linear buckling strength of 400 N/m, which is a conventional value for glazing units of the commonest dimensions, namely 1.20 m by 0.50 m. However, to extend the use to larger glazing units and/or glazing units subjected to extreme stressing conditions, it will be preferable to design glazing units whose insert is capable of withstanding a force of 5700 N per linear metre. To achieve such a buckling strength, we give below a table indicating the safety factor with respect to the 5700 N/m reference according to the corresponding thicknesses to be given to the insert of the invention depending on the type of material.

| Safety factor | Styrene acrylonitrile (SAN) | Aluminum | Stainless steel |
|---|---|---|---|
| 1 | 0.50 mm | 0.25 mm | 0.20 mm |
| 3 | 0.75 mm | 0.40 mm | 0.30 mm |
| 4.5 | 0.90 mm | 0.45 mm | 0.35 mm |

The manufacturing process will now be described with regard to the preferred embodiment of the invention using an insert based on a reinforced thermoplastic.

The glass sheets 10 and 11 are conveyed on edge by standard means to a chamber that may contain the gas to be introduced into the glazing unit.

The glass sheets 10 and 11 are kept at the desired separation by means of suckers placed on the external faces of the glazing unit and controlled by pneumatic cylinders.

Figure 2:
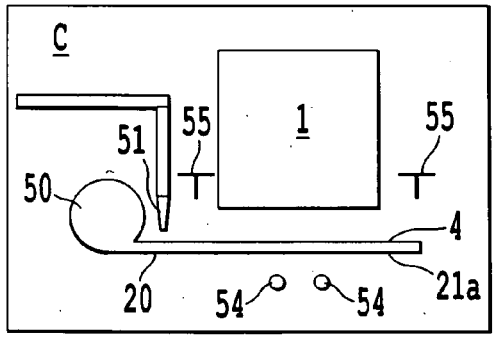
FIG. 2 illustrates a schematic side view of the apparatus for manufacturing the glazing unit.

FIG. 2 illustrates schematically the apparatus for manufacturing the glazing unit within the chamber C.

A reel 50 constitutes the store of the profiled strip 2 which is unwound and stretched, using a stretching device, not shown, in the form of a tape which is cut to the length equivalent to the perimeter of the glazing unit, the width of the tape corresponding to the total thickness of the glazing unit.

Once the profiled strip has been made flat, the adhesive 4 is deposited using injection means 51, such as a nozzle, on that internal face 20 of the tape which is intended to be applied to the edge of the glazing unit. In this case, the tape inherently includes the desiccant on its internal face, the desiccant having been incorporated in the form of a powder or of granules into the reinforced thermoplastic during manufacture of the profiled strip.

However, when the desiccant has to be added subsequently to the manufacture of the profiled strip, it will be preferable for both the desiccant and the adhesive to be put into place during one and the same operation using three injection nozzles, two lateral nozzles aiming at the edges of the tape, for depositing the adhesive so as to be opposite the edges of the glazing unit, and a central nozzle injecting the desiccant to the central part 22 of the tape, so as to be opposite the gas-filled cavity.

It is also possible to envisage an adhesive which is deposited during manufacture of the profiled strip and which is protected until it is used, corresponding here until the application of the profiled strip against the glazing unit.

At least one press roller 54, controlled by an articulated arm, not illustrated, applies and compresses the tape 2 against the edge of the glazing unit 1 over its entire perimeter. To save time in the girding operation, it is preferable to provide two rollers 54 which are driven in two opposed directions and carry out the girding of two halves of the perimeter simultaneously.

Heating means 55, such as two heating wire resistance elements, are provided for heating the profiled strip before it is bent and applied at the corners of the glazing unit.

The operation of the apparatus is as follows.

The two glass sheets 10, 11, held spaced apart, are positioned so as to be stationary in the centre of the chamber C.

Beneath the glazing unit, the profiled strip or tape 2, which includes the desiccant and the fastening means 4, is unwound, stretched and cut.

The two press rollers 54 are brought into contact with the tape in order to apply it to the mid-point of the lower horizontal side of the glazing unit. Once the tape has been pressed against the edge of the glazing unit, the girding operation is started at this mid-point, thus ensuring that the tape is tensioned.

The rollers 54 then move in opposite directions towards the left lower corner 13 and right lower corner 14 of the glazing unit.

Figure 3:
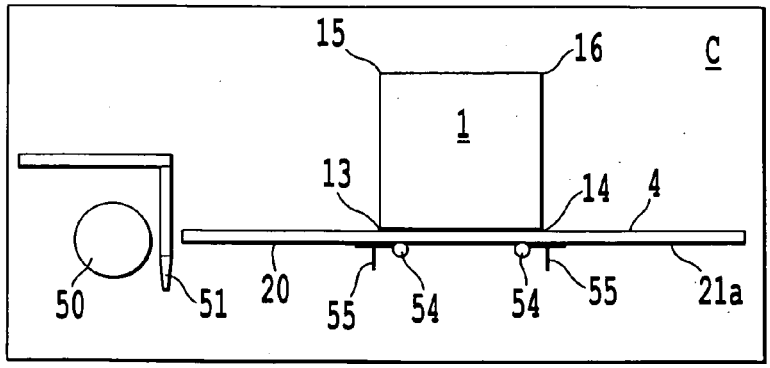
FIG. 3 shows FIG. 2 during one step of the manufacturing process.

Before starting to go around the two corners 13 and 14, the rollers 54 are stopped momentarily, while the heating wires 55 are placed downstream of the rollers, close to and opposite the metal foil 21*a* of the profiled strip in order to heat the thermoplastic intended to be applied against the corners (FIG. 3).

After having softened the profiled strip, the press rollers 54 are again put into operation in order to bend the profiled strip and gird the corners 13 and 14 of the glazing unit correctly. The rollers then continue to travel along the perimeter of the glazing unit until the upper corners 15 and 16 of the glazing unit, at which point the operation of heating the profiled strip is repeated by means of the heating wires 55.

Figure 4:
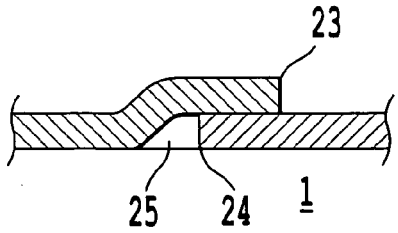
FIG. 4 is an enlarged view of the joining-together of the two free ends of the insert of the invention after the glazing unit has been completely girded.

Once the upper corners of the glazing unit have been girded, the press rollers 54 finish by girding the last side of the glazing unit. On approaching the middle of the latter side, one of the rollers is stopped while the other roller continues to compress the profiled strip until the free end 23 of the profiled strip associated with this operating roller overlaps the other end 24 of the profiled strip fitted (FIG. 4). The girding operation is therefore completed and the press rollers 54 are withdrawn from the glazing unit.

To reinforce the fastening of the two ends 23 and 24 of the tape and above all to seal the two open lateral portions 25 of the tape which are due to the overlap of the ends, complementary sealing means, such as adhesive, are injected so as to seal off these said portions 25.

An alternative way (not illustrated) of joining together the two ends of the tape may consist not in overlapping them but in butting them against each other when they have complementary shapes designed to fit together, in the manner of a mortice and tenon. To ensure that there is complete sealing, some adhesive or an adhesive tape impermeable to gases and to water vapour, such as an adhesive-coated stainless steel tape, will be added to the abutment region.

Although the joint between the two ends of the tape, whether a lap joint or a butt joint, is made along one of the sides of the glazing unit, it is also possible, as a variant, to make this joint at a corner of the glazing unit.

Moreover, in an implementation variant of the process, it is possible to provide two heads 56*a*, 56*b* for dispensing the tape 2, one being stationary and the other able to move vertically, respectively, each associated with a press roller 54, the glazing unit being capable of undergoing a horizontal translational movement.

Referring to FIG. 5*a*, the glazing unit entering the chamber C, which is not illustrated here, is placed between the position ①, corresponding to the front of the glazing unit, and the position ②, corresponding to the rear of the glazing unit. At the start, the movable head 56*b* starts from a lower corner of the glazing unit, corresponding to the position ①, and is actuated upwards in order to follow the front vertical side of the glazing unit. Once the head 56*b* reaches the upper corner, it pivots through 90° and is stopped, the two heads then facing each other. Next, the glazing unit is moved translationally from the left to the right, that is to say the rear of the glazing unit passes from the position ② to the position ①, in order for the horizontal sides of the glazing unit to be simultaneously girded by each of the respective heads (FIG. 5*b*). Finally, the rear of the glazing unit is stopped in the position ① and the vertical side is girded by the movable head which has pivoted through 90° at the upper corner of the glazing unit in order to go down as far as the lower corner (FIG. 5*c*). The two tapes are then fastened together in the lower corners of the glazing unit by a lap joint or a butt joint.

This combination of the translational movements of the glazing unit and of at least one head for dispensing the tape saves time in girding the glazing unit.

Furthermore, this combination of movements and the use of the profiled strip of the invention make it possible to gird complex glazing shapes which have, for example, curved edges with concave and/or convex shapes.

Another way of filling with the gas that has to be contained in the glazing unit may be envisaged. Instead of having to have a chamber filled with gas, a gas supply device such as a hose may be provided, this being inserted between the two glass panes and delivering gas as the edges of the glazing unit are girded and sealed. The device is withdrawn just before the last side of the glazing unit is sealed off.

The profiled strip of the invention has a flat parallelepipedal overall shape, however alternative embodiments are possible. It may, for example, be envisaged to provide the internal face 20 of the profiled strip, on the opposite side to that having the metal coating, with centering and positioning means such as longitudinal projections or studs distributed uniformly along two longitudinal lines separated by a width equivalent to the separation of the two sheets of glass so as to suitably guide and position the profiled strip against the edge of the glazing unit, the projections or studs being inserted into the glazing unit and being pressed against the internal walls.

The invention claimed is:

1. Insulating glazing unit comprising:

at least two glass sheets separated by a gas-filled cavity;

an insert serving for spacing the at least two glass sheets and having an internal face facing the gas-filled cavity and an opposed external face, said insert having a linear buckling strength of at least 400 N/rn, said insert extending to outermost edges of the glass sheets without extending past the outermost edges of the glass sheets; and a sealing element configured to seal an inside of the insulating glazing unit, wherein the insert is in a form of a substantially flat profiled strip that girds a perimeter of the insulating glazing unit by its internal face being pressed against edges of the at least two glass sheets and held fast by a fastener, the insulating glazing unit does not include a spacer contacting facing surfaces of the glass sheets, and the insulating glazing unit does not include a metal coating contacting a facing surface of either of the glass sheets.

2. Insulating glazing unit according to claim 1, wherein the insert seals against gases, dust, and liquid water.

3. Insulating glazing unit according to claim 1, wherein the sealing element is placed at least on the external face of the insert.

4. Insulating glazing unit according to claim 3, wherein the sealing element includes a metal coating.

5. Insulating glazing unit according to claim 1, wherein the insert is entirely metallic.

6. Insulating glazing unit according to claim 3, wherein the insert includes a thermoplastic.

7. Insulating glazing unit according to claim 3, wherein the insert is based on a thermoplastic and reinforcing fibers.

8. Insulating glazing unit according to claim 7, wherein the reinforcing fibers are continuous or chopped glass fibers.

9. Insulating glazing unit according to claim 7, wherein the insert has a thickness of at least 0.25 mm.

10. Insulating glazing unit according to claim 3, wherein the insert includes stainless steel and has a thickness of at least 0.10 mm.

11. Insulating glazing unit according to claim 3, wherein the insert includes aluminum and has a thickness of at least 0.15 mm.

12. Insulating glazing unit according to claim 4, wherein the metal coating has a thickness of between 2 and 50 μm.

13. Insulating glazing unit according to claim 3, wherein the fastener is impermeable to water vapor and to gases.

14. Insulating glazing unit according to claim 3, wherein the fastener includes an adhesive.

15. Insulating glazing unit according to claim 14, wherein the adhesive has a tear strength of at least 0.45 MPa.

16. Insulating glazing unit according to claim 3, wherein the insert has first and second free ends joined together to gird the entire insulating glazing unit so that the first free end overlaps the second free end, and complementary sealing elements are provided to seal off lateral portions left open by the overlap.

17. Insulating glazing unit according to claim 3, wherein the insert has first and second free ends that have complementary shapes configured to fit together to produce an abutment to gird the entire insulating glazing unit.

18. Insulating glazing unit according to claim 17, wherein an adhesive tape, or adhesive, impermeable to gases and to water vapor, is applied to a region of the abutment.

19. Insulating glazing unit according to claim 3, having a complex shape, particularly with curved parts.

20. Insulating glazing unit according to claim 1, wherein said insert is arranged entirely outwardly of the edges of the at least two glass sheets.

21. Insulating glazing unit comprising:

at least two glass sheets separated by a gas-filled cavity;

an insert serving for spacing the at least two glass sheets and having an internal face facing the gas-filled cavity and an opposed external face, said insert having a linear buckling strength of at least 400 N/rn, said insert extending to outermost edges of the glass sheets without extending past the outermost edges of the glass sheets; and a sealing element configured to seal an inside of the insulating glazing unit, wherein the insert is in a form of a substantially flat profiled strip that girds a perimeter of the insulating glazing unit by its internal face being pressed against edges of the at least two glass sheets and held fast by a fastener, a desiccant is associated with said insert, the insulating glazing unit does not include a spacer contacting facing surfaces of the glass sheets, and the insulating glazing unit does not include a metal coating contacting a facing surface of either of the glass sheets.

22. The insulating glazing unit recited in claim 21, wherein said desiccant is partially or completely intrinsically incorporated into said insert material.

23. The insulating glazing unit recited in claim 21, wherein said desiccant is deposited on said internal face of said insert.

* * * * *